US011170650B2

(12) United States Patent
Cooper

(10) Patent No.: US 11,170,650 B2
(45) Date of Patent: Nov. 9, 2021

(54) SYSTEM FOR VEHICLE MONITORING AND ALERTING

(71) Applicant: Peter Cooper, Bethlehem, PA (US)

(72) Inventor: Peter Cooper, Bethlehem, PA (US)

(73) Assignee: Peter Cooper, Bethlehem, PA (US)

( * ) Notice: Subject to any disclaimer, the term of this patent is extended or adjusted under 35 U.S.C. 154(b) by 0 days.

(21) Appl. No.: 16/924,967

(22) Filed: Jul. 9, 2020

(65) Prior Publication Data

US 2021/0012663 A1 Jan. 14, 2021

Related U.S. Application Data

(60) Provisional application No. 62/872,400, filed on Jul. 10, 2019.

(51) Int. Cl.

| | |
|---|---|
| ***G08G 1/16*** | (2006.01) |
| ***G08G 1/04*** | (2006.01) |
| ***G08G 1/01*** | (2006.01) |

(52) U.S. Cl.

CPC ..... *G08G 1/166* (2013.01); *G08G 1/012* (2013.01); *G08G 1/04* (2013.01)

(58) Field of Classification Search

CPC ..... G08G 1/166; G08G 1/012; G08G 1/04
See application file for complete search history.

(56) References Cited

U.S. PATENT DOCUMENTS

| | | | | |
|---|---|---|---|---|
| 10,661,795 | B1 * | 5/2020 | Li | B60W 30/0956 |
| 2013/0144490 | A1 * | 6/2013 | Lord | G08G 1/164 701/41 |
| 2015/0228066 | A1 * | 8/2015 | Farb | G06K 9/00805 348/148 |
| 2015/0329045 | A1 * | 11/2015 | Harris | G06K 9/00805 348/148 |
| 2017/0160392 | A1 * | 6/2017 | Brisimitzakis | G01S 13/931 |
| 2019/0256162 | A1 * | 8/2019 | Denholm | G08G 1/0175 |

* cited by examiner

*Primary Examiner* — Mohamed Barakat

(57) ABSTRACT

Disclosed is a system for detecting multiple approaching vehicles and sending alert signals over a communication network. The system includes one or more vehicle mounted units, wherein at least one vehicle mounted unit is attached to a vehicle for capturing and processing data of approaching vehicles. The vehicle mounted unit includes a camera for capturing digital data, a storage unit to store a set of instructions and a pre-defined time value, a vehicle class list; a processing unit for processing the set of instructions, and a communication unit to send alert signals, vehicles and object digital data over the communication network. The set of instructions includes a detection module for detecting multiple approaching vehicles and objects in a single frame, a measurement module for measuring the time between the camera and the approaching vehicles, and an alert module for generating an alert signal for the rider if the time between the camera and the approaching vehicle is less than the pre-defined time value.

15 Claims, 4 Drawing Sheets

SYSTEM FOR VEHICLE MONITORING AND ALERTING

CROSS REFERENCE TO RELATED APPLICATIONS

The present application claims the benefit of U.S. Provisional Application No. 62/872,400, filed Jul. 10, 2019, which is incorporated by reference herein in its entirety.

BACKGROUND OF THE INVENTION

1. Field of the Invention

The present invention generally relates to a system for vehicle monitoring and alerting, and more particularly relates to a system having a rear camera for object detection and alerting the user.

2. Description of Related Art

Bicycle riders travel either alone or in groups, alongside or within a, outside lane of traffic. The cyclists travel in the same direction as the flow of traffic, but at a slower rate of speed. The rider focuses on the direction of travel, and relies upon awareness and trust of approaching drivers from the rear side.

A bike rider is vulnerable to being impacted by a road vehicle. Unfortunately, instances where the approaching vehicle accidentally clips or hits the bicycle and/or bicycle rider occur, resulting in injury or death of the rider. Many cases have been reported where the rider is killed by the approaching vehicle from the rear.

The law in the USA requires motor vehicles to maintain a 1-meter (3 foot) distance from any cyclist. These laws are designed to help protect the bicyclist however accidents still occur. The number of bicyclists continues to increase, particularly in urban environments, the number of accidents and resulting injuries and deaths also continue to rise.

In some cases the vehicle driver denies responsibility for causing the collision or even flees the scene in a hit a run. This not only leaves the cyclist injured, or worse but in a situation where they cannot be compensated for the damages done to them physically or financially. Therefore, there is a need of a system to detect movement of approaching vehicles from the rear and communicate information over a communication network to alert the rider.

SUMMARY OF THE INVENTION

In accordance with teachings of the present invention, a system for detecting movement of approaching vehicles and sending alert signals over a communication network is provided.

An object of the invention is to provide the system with a one or more vehicle mounted units and a communication unit. At least one vehicle mounted unit is attached to a vehicle for capturing and processing data of approaching vehicles. The vehicle mounted unit includes a camera, a storage unit and a processing unit.

The camera captures digital data. The storage unit stores a set of instructions and a pre-defined time value and a pre-defined vehicle class list. The processing unit is coupled to the storage unit for processing the set of instructions. The set of instructions includes a detection module, a measurement module and an alert module.

The detection module for detecting multiple approaching vehicles and objects in a single frame. The detection module identifies the vehicle class. The measurement module measures the time between the camera and the approaching vehicles. The alert module generates an alert signal if the time between the camera and the approaching vehicle is less than the pre-defined time value. The communication unit is operably connected to the processing unit to send alert signals and captured digital data over the communication network.

Another object of the present invention is to provide a display unit to display the processed set of instructions. Further, the set of instructions includes a green module for displaying a green signal if the time between the approaching vehicle and the camera is more than the pre-defined time value; a yellow module for displaying a yellow signal if the time between the approaching vehicle and the camera is within range to the pre-defined time value; and a red module for displaying a red signal if the time between the approaching vehicle and the camera is less than the pre-defined time value.

Another objective of the present invention is to provide a system wherein the set of instructions further include an arrow module for displaying an arrow to show side of the vehicle having highest threat from approaching vehicles, and a machine learning module for inferring objects and vehicles using neural networks. Further the machine learning module communicates the updated information over the communication network.

Another objective of the present invention is to provide a system with a server unit operably connected to each of the vehicle mounted units for processing the received captured digital data over the communication network, and an output unit connected to the processing unit to generate an output on receiving the alert signal.

Another objective of the present invention is to provide a system wherein the set of instructions further include a number module for displaying a number representing number of vehicles approaching in the red module, the yellow module and the green module, and a messaging module for communicating with other communication units installed in the vehicle mounted unit of the approaching vehicles.

Another objective of the present invention is to provide a system with a GPS unit to send location of the vehicle over the communication network. The foregoing and other features and advantages of the disclosed technology will become more apparent from the following detailed description, which proceeds with reference to the accompanying figures.

DETAILED DESCRIPTION OF DRAWINGS

While the specification concludes with claims defining the features of the invention that are regarded as novel, it is believed that the invention will be better understood from a consideration of the description of exemplary embodiments in conjunction with drawings. It is of course to be understood that the embodiments described herein are merely exemplary of the invention, which can be embodied in various forms. Therefore, specific structural and functional details disclosed in relation to the exemplary embodiments described herein are not to be interpreted as limiting, but merely as a representative basis for teaching one skilled in the art to variously employ the present invention in virtually any appropriate form, and it will be apparent to those skilled in the art that the present invention may be practiced without these specific details. Further, the terms and phrases used herein are not intended to be limiting but rather to provide an understandable description of the invention.

Figure 1:
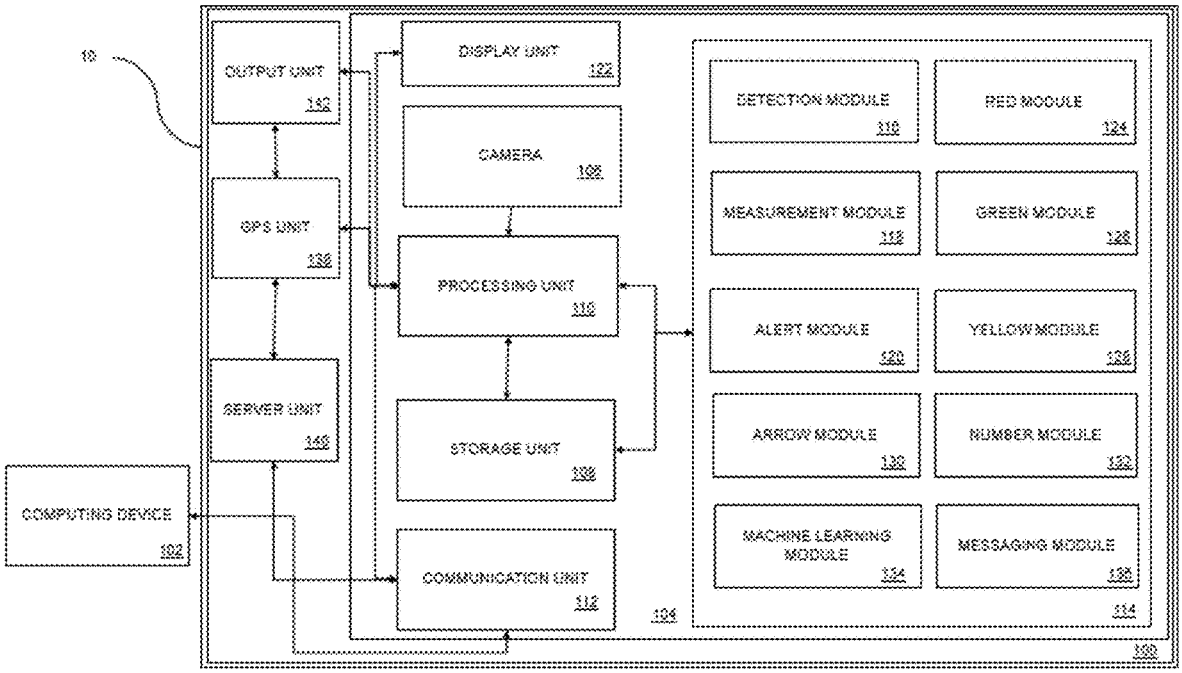
FIG. 1 illustrates a block diagram of a system for detecting multiple approaching vehicles and sending alert signals over a communication network.

FIG. 1 illustrates a block diagram of a system 100 for detecting multiple approaching vehicles and sending alert signals over a communication network. The system 100 generally sends the detection data and alert signals to a computing device 102 over the communication network. Examples of the computing device 102 includes but not limited to a computer, laptop, iPad, super computers, smart watches, smart phones and other similar computing devices.

Figure 2:
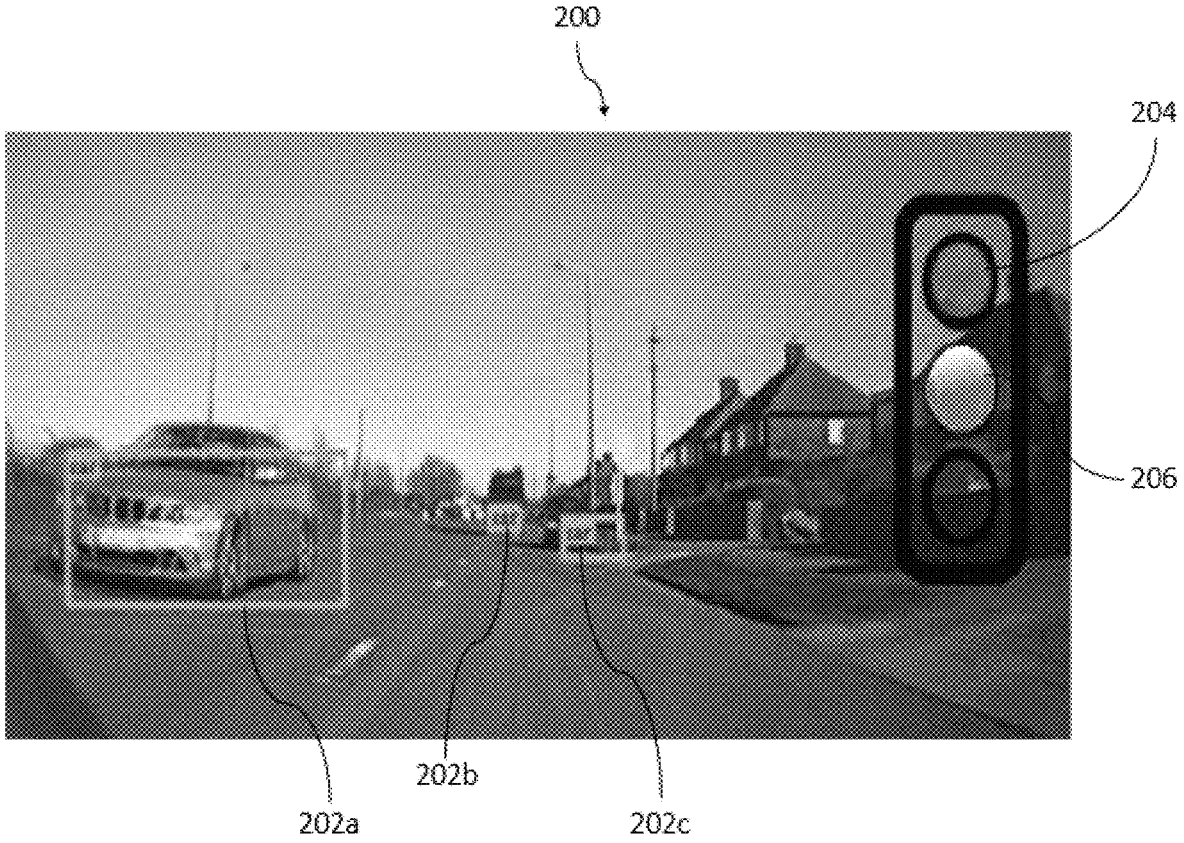
FIG. 2 illustrates a screenshot from a rear camera detecting approaching vehicles in an exemplary embodiment of the present invention.

The system 100 includes one or more vehicle mounted units, wherein at least one vehicle mounted unit 104 is attached to a vehicle 10 for capturing and processing data of approaching vehicles. The approaching vehicles are shown in FIG. 2 of the present invention. The vehicle mounted unit 104 includes a camera 106, a storage unit 108, a processing unit 110, and a communication unit 112.

Examples of vehicle 10 include but not limited to a car, truck, bus, e-bikes, bike, scooter, tri-bikes, quad-bikes etc. The attachment of the camera 106 on the vehicle 10 is shown and explained in FIG. 3 of the present invention.

The camera 106 captures digital data. Examples of digital data includes but not limited to audio, video, images and combination of audio, video and images. The camera 106 captures digital data of approaching vehicles (cars, trucks, bikes, buses etc.) and other objects (animals, barricades, birds, utensils, equipment, furniture, humans etc.). In a preferred embodiment of the present invention, the camera 106 sends captured data in real time and communicates the real time data to the computing device 102 via the communication unit 112.

Examples of the camera 104 include but not limited to High Definition (HD) camera, infra-red camera, night vision cameras, charge coupled devices (CCD) cameras motion detector cameras, dark fighter technology cameras, license plate recognition (LPR) cameras and automatic number plate recognition (ANRP) cameras for obtain copious information in a high traffic area to keep any premises secure etc.

In a preferred embodiment, the computing unit 102 is a smartphone attached to the handlebar of the vehicle 10. However, it would be readily apparent to those skilled in the art that various types of computing unit 102 (such as graphical user interface, smart watches, IPad, computers) may be envisioned without deviating from the scope of the present invention.

The storage unit 108 stores a set of instructions 114 and a pre-defined time value and a pre-defined vehicle class list. The pre-defined time value is a threshold time value defining the time required by the approaching vehicle to reach to the vehicle 10. The pre-defined vehicle class list includes name of the different type of vehicles. Examples of the storage unit 108 include but not limited to hard disk drive, magnetic disk drive, optical disk drive, flash memory etc.

The processing unit 110 is coupled to the storage unit 108 for processing the set of instructions 114. Example of the processing unit 110 includes but not limited to a processor, a microcontroller, a controller, a microprocessor, and other similar processing units. The set of instructions 114 include a detection module 116, a measurement module 118, and an alert module 120.

The detection module 116 detects multiple approaching vehicles and objects in a single frame. The detection module 116 identifies the vehicle class and the number of vehicles approaching towards the vehicle 10. The detection module 116 is explained in detail in conjunction with FIG. 2 of the present invention.

The measurement module 118 measures the time between the camera 106 and the approaching vehicles. It would be readily apparent to those skilled in the art that the measurement module 118 may be used to measure distance and speed of approaching vehicles. The measurement module 118 is explained in detail in conjunction with FIG. 2 of the present invention.

The alert module 120 generates an alert signal if the time between the camera and the approaching vehicle is less than the pre-defined time value. The communication unit 112 is operably connected to the processing unit 110 to send alert signals and captured digital data over the communication network. The captured data represents data of objects and the approaching vehicles. Examples of the communication unit 112 include but not limited to Bluetooth, NFC, Wi-Fi, cellular communication, CDMA, GSM, wired communication connections like USB cable or serial cable etc.

Further in another preferred embodiment of the present invention, the processing unit 110 measures the acceleration of rider's vehicle or approaching vehicle, velocity, speed of rider's vehicle, motor power, road conditions, environmental conditions, rider's condition etc. to determine the threat level.

In another embodiment of the present invention, the system 100 further includes a digital display unit 122 for displaying the processed set of instructions 114. Examples of the display unit 122 includes but not limited to OLED, LED, LCD and other similar digital, display units. The set of instructions 114 include a red module 124, a green module 126 and a yellow module 128. The red module 124, the green module 126 and the yellow module 128 are explained in detail in conjunction with FIG. 2 of the present invention.

In another embodiment of the present invention, the set of instructions 114 further include an arrow module 130 for displaying an arrow to show a side of the vehicle having highest threat from approaching vehicles, and a number module 132 for displaying a number representing number of vehicles approaching in the red module 124, the yellow module 128 and the green module 126. The arrow module 130 and the number module 132 is explained in detail in conjunction with FIG. 2 of the present invention.

In another embodiment of the present invention, the set of instructions 114 further include a machine learning module 134 for inferring objects and vehicles using neural networks. The machine learning module 134 communicates the updated information over the communication network. For exemplary purposes, the machine learning module 134 identifies each approaching vehicle and classifies them. Further, the information of the approaching vehicle is displayed through the display unit 122.

Further, the set of instruction 114 includes a messaging module 136 for communicating with other communication units installed in the vehicle mounted unit of the approaching vehicles. The messaging module 136 allows a rider to inform approaching vehicles to slow down if they are moving too fast. Further, the purpose of the messaging module 136 is to inform each vehicle may safely avoid one another and create an efficient and comfortable ride for passengers.

In another preferred embodiment of the present invention, the system further includes a GPS unit 138 to send location of the vehicle 10 over the communication network. The GPS unit 138 allows the rider family to know about their whereabouts of the vehicle 10. Further, the GPS unit 138 let the rider know the position of their vehicle 10 when away from them. Further, a manager may keep track of the fleet of vehicles with the GPS unit 138.

In another preferred embodiment of the present invention, the system 100 includes a server unit 140 operably connected to each of the vehicle mounted units 104 for processing the received captured digital data over the communication network. The server 140 may be used to monitor each vehicle having vehicle mounted unit 104.

Further, the server 140 is used to establish communication between each vehicle mounted unit 104. It would be readily apparent to those skilled in the art that various information and data may be processed from the server 140 without deviating from the scope of the present invention. The server 114 provides memory for data collected in the cloud and provides additional processing for the data in a non-real-time manner to identify the type of vehicle, objects etc.

In another preferred embodiment of the present invention, the system 100 includes an output unit 142 connected to the processing unit 110 to generate an output on receiving the alert signal. Examples of the output unit 142 include but not limited to a speaker, vibrator, LED's and other similar output units 142 to alert the rider.

It would be readily apparent to those skilled in the art that the core invention lies in the set of instructions processing the data captured by the camera, and thus set of instructions may be processed by a local processor or the processor of the smartphone/computing device without deviating from the scope of the present invention.

Thus, in another embodiment of the present invention, a system 100 for detecting multiple approaching vehicles and sending alert signals to a computing device 102 over a communication network is disclosed. The system 100 includes one or more vehicle mounted units, wherein at least one vehicle mounted unit 104 is attached to a vehicle 10 for capturing and communicating data of approaching vehicles to the computing device 102.

The vehicle mounted unit 104 includes a camera 106 for capturing digital data and a plurality of set of instructions 114 processed by the computing device 102. The plurality of set of instructions 114 includes a storage module for storing a pre-defined time value and a pre-defined vehicle class list, a detection module, a measurement module, and an alert module for communicating alert signals to the computing device 102.

The storage module is identically similar to the storage unit, and the detection module, the measurement module and the alert module are explained in para [0027] to para [0031]. Further, the system 100 includes a graphical user interface (not shown in FIGURES) to display the processed set of instructions on a display of the computing device 102.

FIG. 2 illustrates a screenshot 200 of the digital display unit showcasing data from a rear camera (106, shown in FIG. 1) detecting multiple approaching vehicles 202*a*, 202*b*, 202*c* in an exemplary embodiment of the present invention.

A red light 204 is displayed to indicate the high potential hazard level i.e. time required for the approaching vehicle 202*a* to meet with the camera (106, shown in FIG. 1) is less than the pre-defined time value; and a yellow light 206 indicates the caution potential hazard level i.e. time required for the approaching vehicle 202*b*, 202*c* to meet with the camera (106, shown in FIG. 1) is similar or in range to the pre-defined time value.

Figure 3:
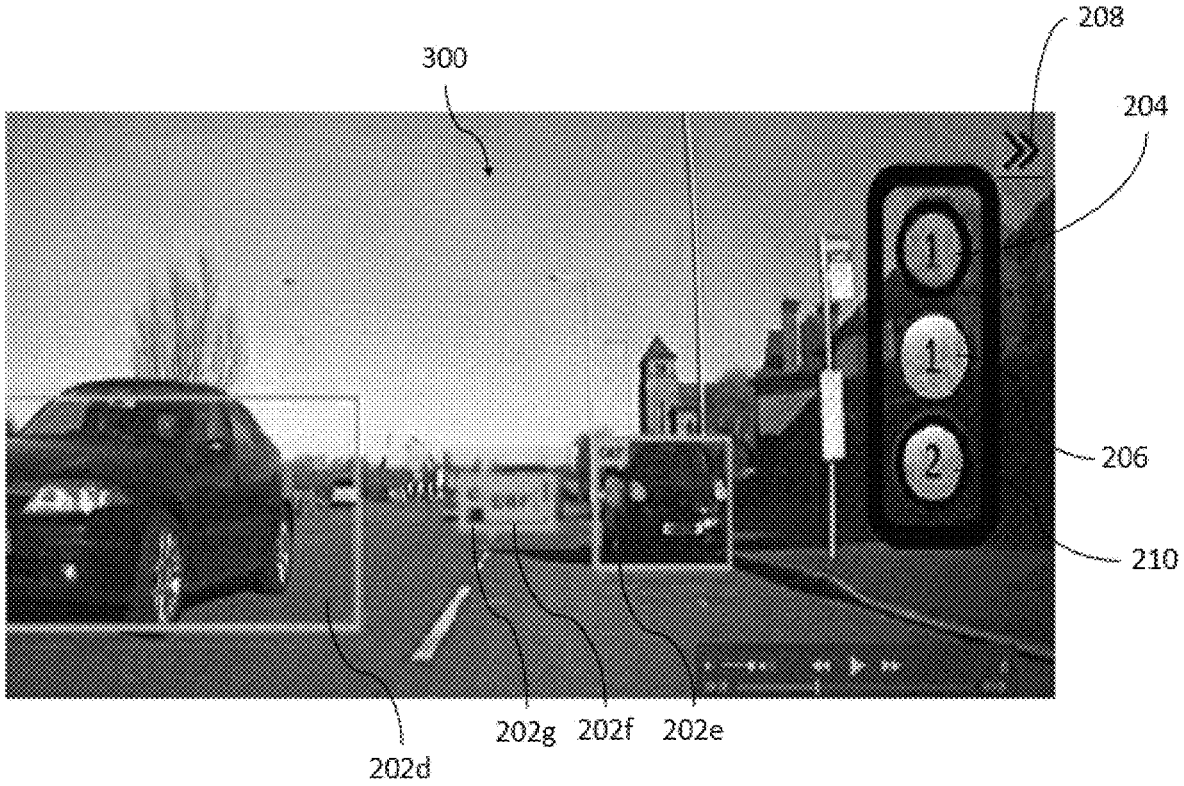
FIG. 3 illustrates another screenshot from a rear camera showing direction and number of vehicles approaching the vehicles.

FIG. 3 illustrates another screenshot 300 of the digital display unit showcasing data from a rear camera showing direction and number of vehicles 202*d*, 202*e*, 202*f* approaching the vehicles. The vehicle 202*d* at high potential hazard level, the vehicle 202*e* at a caution potential hazard level and vehicles 202*f*, 202*g* at low potential hazard level via a green light 210.

Further the numbers are indicated on the digital display unit in the light representing the number of approaching vehicles approaching the camera (106, shown in FIG. 1). As shown on the digital display unit, 1 in red light 20, represents one approaching vehicle in high hazard level, 1 in yellow, represents one approaching vehicle in moderate hazard level and 2 in green represents two approaching vehicles in low hazard level. Further, an arrow 208 indicates the side of the vehicle having highest threat from approaching vehicles i.e. either left or right.

Figure 4:
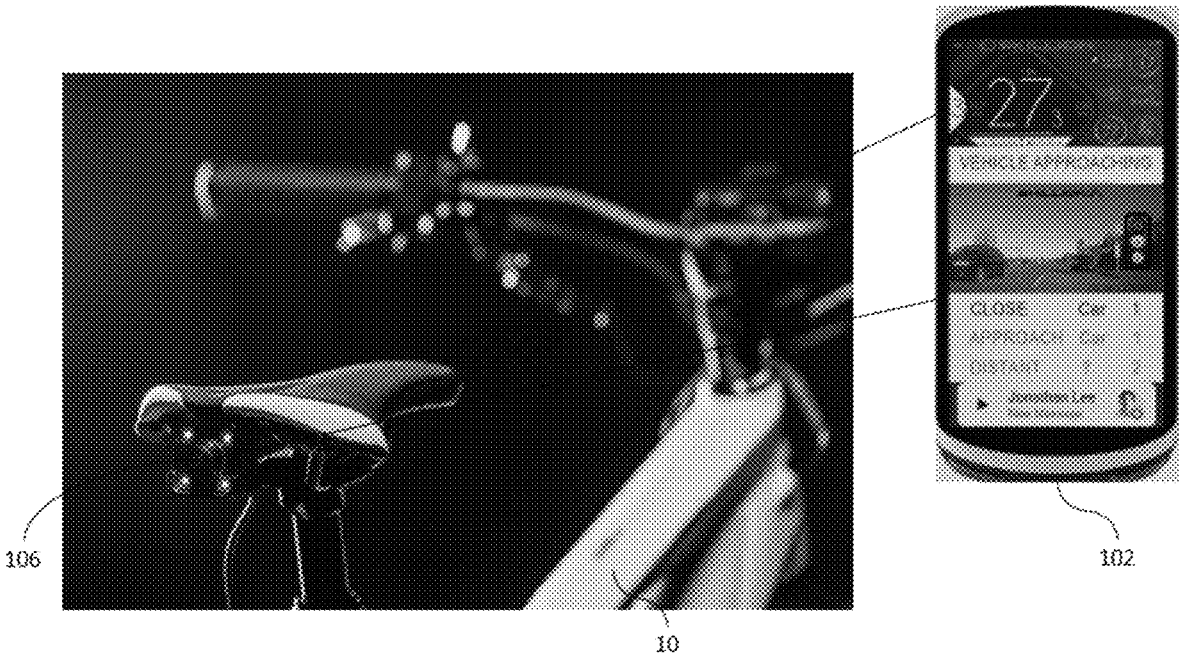
FIG. 4 illustrates a schematic view of the rear camera and a computing device attached to a vehicle in accordance with a preferred embodiment of the present invention.

FIG. 4 illustrates a schematic view of the rear camera 106 and a computing device 102 attached to a vehicle 10 in accordance with a preferred embodiment of the present invention. It would be readily apparent to those skilled in the art that the rear camera 106 may be attached to other places apart from the vehicle 10 such as riders backpack, rider's vest or belt etc. without deviating from the scope of the present invention.

The camera 106 captures digital data and transmits the data to the computing device 102. The computing device 102 may either be a local electronics unit with a processor, storage and a display, or central electronics unit such as a smartphone, iPad, smartwatch, a connected dashboard to display the processed set of instructions etc.

It would be readily apparent to those skilled in the art that the various variables for detecting of threat depends on many variables such as bike speed, time to arrive, size, speed of approaching vehicle, general conditions on the road and visibility may be envisioned without deviating from the scope of the present invention.

The present application offers various advantage such as warns of approaching vehicles, detects multiple vehicles in a single frame, announces type of the vehicles, displays and records the captured data. Further, the present invention provides safety to a rider and creates a peace of mind.

While the invention has been described in detail with reference to exemplary embodiments, it will be understood by those skilled in the art that various changes and alternations may be made and equivalents may be substituted for elements thereof without departing from the scope of the invention as defined by the appended claims. In addition, many modifications may be made to adapt a particular application or material to the teachings of the invention without departing from the essential scope thereof.

Variations described for exemplary embodiments of the present invention can be realized in any combination desirable for each particular application. Thus, particular limitations, and/or embodiment enhancements described herein, which may have particular limitations need be implemented in methods, systems, and/or apparatuses including one or more concepts describe with relation to exemplary embodiments of the present invention.

Therefore, it is intended that the invention not be limited to the particular embodiments disclosed as the best mode contemplated for carrying out this invention, but that the invention will include all embodiments falling within the scope of the present application as set forth in the following claims, wherein reference to an element in the singular, such as by use of the article "a" or "an" is not intended to mean "one and only one" unless specifically so stated, but rather "one or more." Moreover, no claim element is to be construed under the provisions of 35 U.S.C. § 112, sixth paragraph, unless the element is expressly recited using the phrase "means for" or "step for." These following claims should be construed to maintain the proper protection for the present invention.

The invention claimed is:

1. A system for detecting multiple approaching vehicles and sending alert signals over a communication network, the system comprising:

one or more vehicle mounted units, wherein at least one vehicle mounted unit is attached to a vehicle for capturing and processing data of approaching vehicles, the vehicle mounted unit comprising:

a camera for capturing digital data;

a storage unit to store a set of instructions and a pre-defined time value and a pre-defined vehicle class list;

a digital display unit to display processed set of instructions;

a processing unit coupled to the storage unit for processing the set of instructions, wherein the set of instructions comprising:

a detection module for detecting multiple approaching vehicles and objects in a single frame, further the detection module identifies the vehicle class and the number of vehicles approaching the vehicle;

a measurement module for measuring the time between the camera and the approaching vehicles;

an alert module for generating an alert signal if the time between the camera and the approaching vehicle is less than the pre-defined time value;

a green module coupled to the measurement module for displaying a green signal on the digital display unit if the time between the approaching vehicle and the camera is more than the pre-defined time value;

a yellow module coupled to the measurement module for displaying a yellow signal on the digital display unit if the time between the approaching vehicle and the camera is within range to the pre-defined time value;

a red module coupled to the measurement module for displaying a red signal on the digital display unit if the time between the approaching vehicle and the camera is less than the pre-defined time value;

a number module coupled to the detection module and to the measurement module for displaying on the digital display unit a number representing number of vehicles approaching in the red signal, another number representing number of vehicles approaching in the yellow signal and another number representing number of vehicles approaching in the green signal; and a communication unit operably connected to the processing unit to send alert signals and captured digital data over the communication network.

2. The system according to claim 1 wherein the set of instructions further comprising an arrow module for displaying an arrow to show side of the vehicle having highest threat from approaching vehicles.

3. The system according to claim 1 further comprising a server unit operably connected to each of the vehicle mounted units for processing the received captured digital data over the communication network.

4. The system according to claim 1 further comprising an output unit connected to the processing unit to generate an output on receiving the alert signal.

5. The system according to claim 1 wherein the set of instructions further comprising a machine learning module for inferring objects and vehicles using neural networks, and further the machine learning module communicates the updated information over the communication network.

6. The system according to claim 1 wherein at least one vehicle mounted unit is attached to an approaching vehicle, and the set of instructions further comprising a messaging module for communicating with other communication units installed in the vehicle mounted unit of the approaching vehicles.

7. The system according to claim 1 further comprising a GPS unit to send location of the vehicle over the communication network.

8. A system for detecting multiple approaching vehicles and sending alert signals to a computing device over a communication network, the system comprising:

one or more vehicle mounted units, wherein at least one vehicle mounted unit is attached to a vehicle for capturing and communicating data of approaching vehicles to the computing device, the vehicle mounted unit comprising:

a camera for capturing digital data; and plurality of set of instructions processed by the computing device, wherein the plurality of set of instructions comprising:

a storage module for storing a pre-defined time value and a pre-defined vehicle class list;

a detection module for detecting multiple approaching vehicles and objects in a single frame, further the detection module identifies the vehicle class and the number of vehicles approaching the vehicle;

a measurement module for measuring the time between the camera and the approaching vehicles; and an alert module for generating an alert signal if the time between the camera and the approaching vehicle is less than the pre-defined time value, further the alert module communicates alert signal to the computing device;

a graphical user interface to display the processed set of instructions on a digital display unit of the computing device;

wherein the set of instructions further comprising:

a green module coupled to the measurement module for displaying a green signal on the graphical user interface of the computing device if the time between the approaching vehicle and the camera is more than the pre-defined time value;

a yellow module coupled to the measurement module for displaying a yellow signal on the graphical user interface of the computing device if the time between the approaching vehicle and the camera is within range to the pre-defined time value;

a red module coupled to the measurement module for displaying a red signal on the graphical user interface of the computing device if the time between the approaching vehicle and the camera is less than the pre-defined time value; and a number module coupled to the detection module and to the measurement module for displaying on the digital display unit a number representing number of vehicles approaching in the red signal, another number representing number of vehicles approaching in the yellow signal and another number representing number of vehicles approaching in the green signal.

9. The system according to claim 8 further comprising a communication unit to communicate the alert signals received from the alert module to the computing device.

10. The system according to claim 8 wherein the set of instructions further comprising an arrow module for displaying an arrow on the display of the computing device to show side of the vehicle having highest threat from approaching vehicles.

11. The system according to claim 8 further comprising a server unit operably connected to each of the vehicle mounted units for processing the received captured digital data over the communication network.

12. The system according to claim 8 further comprising an output unit connected to the computing device to generate an output on receiving the alert signal.

13. The system according to claim 8 wherein the set of instructions further comprising a machine learning module for inferring objects and vehicles using neural networks, and further the machine learning module communicates the updated information over the communication network.

14. The system according to claim 8 wherein at least one vehicle mounted unit is attached to the approaching vehicle, and the set of instructions further comprising a messaging module for communicating with other communication units installed in the vehicle mounted unit of the approaching vehicles.

15. The system according to claim 8 further comprising a GPS unit to send location of the vehicle over the communication network.

* * * * *